US007431827B2

(12) United States Patent
Rock et al.

(10) Patent No.: US 7,431,827 B2
(45) Date of Patent: Oct. 7, 2008

(54) PROCESS FOR THE PRODUCTION OF LOW SULFUR, LOW OLEFIN GASOLINE

(75) Inventors: Kerry L. Rock, Houston, TX (US); Yi-Gang Xiong, Houston, TX (US); Arvids Judzis, Jr., Houston, TX (US)

(73) Assignee: Catalytic Distillation Technologies, Pasadena, TX (US)

( * ) Notice: Subject to any disclaimer, the term of this patent is extended or adjusted under 35 U.S.C. 154(b) by 565 days.

(21) Appl. No.: 10/974,666

(22) Filed: Oct. 27, 2004

(65) Prior Publication Data

US 2006/0086645 A1 Apr. 27, 2006

(51) Int. Cl.
*C10G 45/02* (2006.01)

(52) U.S. Cl. ..... 208/208 R; 208/211; 208/212; 208/213

(58) Field of Classification Search ..... None
See application file for complete search history.

(56) References Cited

U.S. PATENT DOCUMENTS

| | | | | |
|---|---|---|---|---|
| 4,179,361 | A | 12/1979 | Michlmayr | 208/244 |
| 4,188,285 | A | 2/1980 | Michlmayr | 208/246 |
| 4,204,947 | A | 5/1980 | Jacobson et al. | 208/243 |
| 4,215,011 | A | 7/1980 | Smith, Jr. | 252/426 |
| 4,336,407 | A | 6/1982 | Smith, Jr. | 568/697 |
| 4,634,515 | A | 1/1987 | Bailey et al. | 208/91 |
| 4,830,734 | A | 5/1989 | Nagji et al. | 208/208 R |
| 4,950,803 | A * | 8/1990 | Smith, Jr. et al. | 568/697 |
| 5,320,742 | A | 6/1994 | Fletcher et al. | 208/89 |
| 5,321,163 | A | 6/1994 | Hickey et al. | 568/59 |
| 5,405,814 | A * | 4/1995 | Beech, Jr. et al. | 502/53 |
| 5,510,568 | A | 4/1996 | Hearn | 585/834 |
| 5,595,634 | A | 1/1997 | Hearn et al. | 203/29 |
| 5,597,476 | A | 1/1997 | Hearn et al. | 208/208 R |
| 5,628,880 | A | 5/1997 | Hearn et al. | 203/29 |
| 5,779,883 | A | 7/1998 | Hearn et al. | 208/213 |
| 5,807,475 | A | 9/1998 | Kulprathipanja et al. | 208/208 R |
| 5,807,477 | A | 9/1998 | Hearn et al. | 208/238 |
| 5,894,076 | A | 4/1999 | Hearn et al. | 585/251 |
| 6,083,378 | A | 7/2000 | Gildert et al. | 208/209 |
| 6,096,194 | A | 8/2000 | Tsybulevskiy et al. | 208/244 |
| 6,232,509 | B1 | 5/2001 | Smith, Jr. et al. | 568/697 |
| 6,495,030 | B1 | 12/2002 | Podrebarac | 208/218 |
| 6,676,830 | B1 | 1/2004 | Vichailak et al. | 208/210 |
| 2003/0230517 | A1 | 12/2003 | Groten | 208/209 |
| 2004/0178123 | A1 | 9/2004 | Podrebarac | 208/211 |

OTHER PUBLICATIONS

International Application No. PCT/US05/029395; International Search Report dated Oct. 12, 2007 (8 pages).

* cited by examiner

*Primary Examiner*—Tam Nguyen
(74) *Attorney, Agent, or Firm*—Osha Liang LLP

(57) ABSTRACT

A process for the production of low sulfur, low olefin gasoline wherein a cracked naphtha, such as a full boiling range cracked naphtha, is first separated by fractional distillation into at least two fractions while simultaneously selectively hydrogenating the polyunsaturated compounds contained therein. The mono olefins in the light fraction are then subjected to etherification with alcohol to produce ethers or hydration with water to produce alcohols. The heavy fraction is subjected to sulfur removal by hydrodesulfurization or chemisorption. The two fractions are then combined to produce a low sulfur, low olefin gasoline.

17 Claims, 1 Drawing Sheet

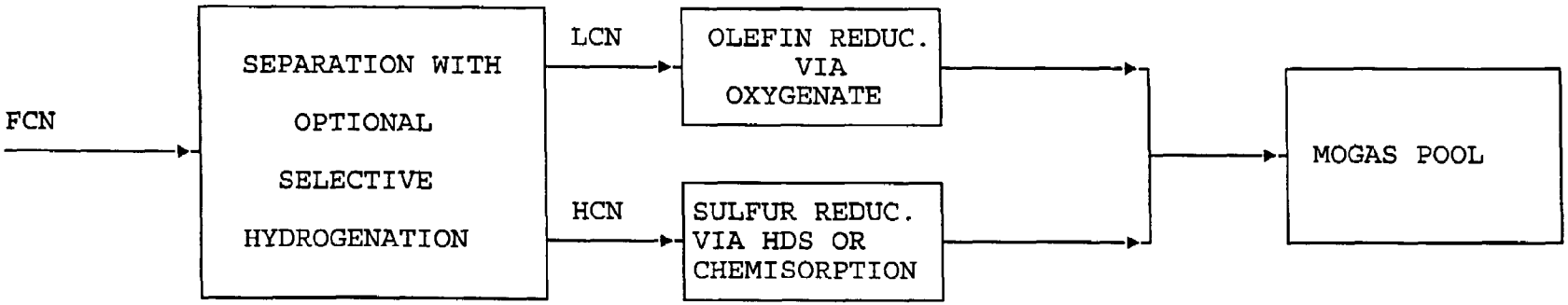
FCN
SEPARATION WITH
OPTIONAL
SELECTIVE
HYDROGENATION
LCN
HCN
OLEFIN REDUC.
VIA
OXYGENATE
SULFUR REDUC.
VIA HDS OR
CHEMISORPTION
MOGAS POOL

PROCESS FOR THE PRODUCTION OF LOW SULFUR, LOW OLEFIN GASOLINE

BACKGROUND OF THE INVENTION

1. Field of the Invention

The present invention relates to an integrated process for producing a low sulfur, low olefin gasoline from a cracked naphtha, such as a full boiling range cracked naphtha stream. More particularly the stream is divided into at least two streams for individual treatment as required. Specifically the individual streams are hydrogenated, reacted to produce oxygenates and desulfurized.

2. Related Information

Petroleum distillate streams contain a variety of organic chemical components. Generally the streams are defined by their boiling ranges which determine the compositions. The processing of the streams also affects the composition. For instance, products from either catalytic cracking or thermal cracking processes contain high concentrations of olefinic materials as well as saturated (alkanes) materials and polyunsaturated compounds (e.g., diolefins). Additionally, these components may be any of the various isomers of the compounds.

The composition of untreated naphtha as it comes from the crude still, or straight run naphtha, is primarily influenced by the crude source. Naphthas from paraffinic crude sources have more saturated straight chain or cyclic compounds. As a general rule most of the "sweet" (low sulfur) crudes and naphthas are paraffinic. The naphthenic crudes contain more unsaturates and cyclic and polycylic compounds. The higher sulfur content crudes tend to be naphthenic. Treatment of the different straight run naphthas may be slightly different depending upon their composition due to crude source.

Reformed naphtha or reformate generally requires no further treatment except perhaps distillation or solvent extraction for valuable aromatic product removal. Reformed naphthas have essentially no sulfur contaminants due to the severity of their pretreatment for the process and the process itself.

Cracked naphtha as it comes from the catalytic cracker has a relatively high octane number as a result of the olefinic and aromatic compounds contained therein. Frequently this fraction may contribute as much as half of the gasoline in the refinery pool together with a significant portion of the octane, and in some cases it may even contribute up to 90% of the gasoline in the refinery pool.

Catalytically cracked naphtha gasoline boiling range material currently forms a significant part (≈⅓) of the gasoline product pool in the United States and it provides the largest portion of the sulfur. The sulfur impurities may require removal, usually by hydrotreating, in order to comply with product specifications or to ensure compliance with environmental regulations. Now environmental concerns are requiring the removal of olefins. Both sulfur and olefin maximum contents are being lowered.

The most common method of removal of the sulfur compounds is by hydrodesulfurization (HDS) in which the petroleum distillate is passed over a solid particulate catalyst comprising a hydrogenation metal supported on an alumina base. Additionally copious quantities of hydrogen are included in the feed. The following equations illustrate the reactions in a typical HDS unit:

$$RSH+H_2 \longrightarrow RH+H_2S \quad (1)$$

$$RCl+H_2 \longrightarrow RH+HCl \quad (2)$$

$$RN+2H_2 \longrightarrow RH+NH_3 \quad (3)$$

$$ROOH+2H_2 \longrightarrow RH+2H_2O \quad (4)$$

Typical operating conditions for the HDS reactions are:

| | |
|---|---|
| Temperature, ° F. | 600-780 |
| Pressure, psig | 600-3000 |
| $H_2$ recycle rate, SCF/bbl | 1500-3000 |
| Fresh $H_2$ makeup, SCF/bbl | 700-1000 |

The reaction of organic sulfur compounds in a refinery stream with hydrogen over a catalyst to form $H_2S$ is typically called hydrodesulfurization. Hydrotreating is a broader term which includes saturation of olefins and aromatics and the reaction of organic nitrogen compounds to form ammonia. However hydrodesulfurization is included and is sometimes simply referred to as hydrotreating.

After the hydrotreating is complete, the product may be fractionated or simply flashed to release the hydrogen sulfide and collect the now desulfurized naphtha.

The conditions of hydrotreating of the naphtha fraction to remove sulfur will also saturate some of the olefinic compounds in the fraction. However, this incidental olefin hydrogenation is usually not sufficient to meet the CARB requirements.

Since the olefins in the cracked naphtha are mainly in the low boiling fraction of these naphthas and the sulfur containing impurities tend to be concentrated in the high boiling fraction the most common method of treatment has been prefractionation prior to hydrotreating. The prefractionation produces a light boiling range naphtha which boils in the range of $C_5$ to about 250° F. ($C_4$ to about 250° F. if $C_4$'s are present in the naphtha stream) and a heavy boiling range naphtha which boils in the range of from about 250-475° F.

The predominant light or lower boiling sulfur compounds are mercaptans while the heavier or higher boiling compounds are thiophenes and other heterocyclic compounds. The separation by fractionation alone will not remove the mercaptans. However, in the past the mercaptans were frequently converted to sulfides by oxidative processes involving caustic washing. A combination oxidative conversion of the mercaptans followed by fractionation and hydrotreating of the heavier fraction is disclosed in U.S. Pat. No. 5,320,742.

The lighter fraction may be subjected to further separation to convert the $C_5$ olefins (amylenes) which are useful in preparing valuable ethers.

More recently a new technology has allowed for the simultaneous treatment and fractionation of petroleum products, including naphtha, especially fluid catalytically cracked naphtha (FCC naphtha). See, for example, commonly owned U.S. Pat. Nos. 5,510,568; 5,597,476; 5,779,883; 5,807,477 and 6,083,378.

Full boiling range FCC naphtha has been hydrotreated in a splitter which contains a thioetherification catalyst in the upper portion. Mercaptans in the light fraction react with the diolefins contained therein (thioetherification) to produce higher boiling sulfides which are removed as bottoms along with the heavy (higher boiling) FCC naphtha. Similarly, the light fraction has been treated to saturate dienes. The bottoms are usually subjected to further hydrodesulfurization.

It is an advantage of the present invention that the sulfur may be removed from the light olefin portion of the stream to a heavier portion of the stream and the olefins converted to valuable octane enhancers. Substantially all of the sulfur in the heavier portion is converted to $H_2S$ by hydrodesulfurization and easily distilled away from the hydrocarbons.

SUMMARY OF THE INVENTION

Briefly in the present integrated process a cracked naphtha is first separated into at least two streams, a light cracked naphtha and a heavy cracked naphtha. The light cracked naphtha is fed to a first reactor where the isoolefins are reacted with either alcohols or water to produce an oxygenated compound, thus reducing the olefin content. The heavy or medium cracked naphtha is fed to a separate reactor where the organic sulfur compounds are removed, preferably by chemisorption or conversion to $H_2S$ which is removed, thus reducing the sulfur content. In a preferred embodiment a full boiling range cracked naphtha is concurrently separated by fractional distillation in a distillation column reactor where the diolefins and polyunsaturated compounds are selectively hydrogenated to monoolefins concurrently with the fractionation. Preferably the etherification/hydration and desulfurization reactions are also carried out in distillation column reactors.

The present invention includes removal of sulfur from a full boiling range cracked naphtha stream to meet higher standards for sulfur removal by splitting the light portion of the stream and treating the different components in the most effective manner. The light fraction is treated to react a portion of the olefins therein to produce oxygenated compounds. The oxygenates may be either ethers or alcohols. Thus the loss of octane due to the removal of the olefins, which make up part of the higher octane components, is more than offset by conversion of the olefins to higher octane oxygenates.

The heavier fraction is subjected to hydrodesulfurization to remove sulfur to acceptable levels. In the alternative the heavier fraction may have the sulfur removed by known chemisorption processes. If desired the entire cracked naphtha stream may be subjected to selective hydrogenation of polyunsaturated compounds concurrently with the first fractionation or splitting.

BRIEF DESCRIPTION OF THE DRAWING

The FIGURE is a general block flow diagram of the overall invention.

DETAILED DESCRIPTION

The present invention may be understood by reference to the attached FIGURE which is a block process flow diagram. A full boiling range cracked naphtha (FRCN) generally considered as having a boiling range from about $C_5$-475° F. (although a lower end point may be selected) is fed to a first separation process, such as a fractional distillation column, where it is separated into at least two fractions—a light cracked naphtha (LCN) boiling in the range from about $C_5$-250° F. and a heavy cracked naphtha (HCN) boiling in the range of about 250-475° F. (or the selected end point). If desirable the distillation column can contain a selective hydrogenation catalyst and hydrogen may be fed counter currently at the bottom of the column. In the distillation column the polyunsaturated compounds such as dienes and acetylenes, are selectively hydrogenated to monoolefins.

The LCN is fed to a reactor where a portion of the olefins are reacted either with water to produce an alcohol or with an alcohol to produce an ether thus reducing the olefin content of the LCN. Most notably the isoolefins will react first with the normal olefins reacting more slowly. In a preferred embodiment the reactor is a distillation column reactor containing a bed of acidic cation exchange resin catalyst which catalyzes either reaction concurrently with distillation.

The reaction of an alcohol and an olefin and concurrent separation of the reactants from the reaction products by fractional distillation has been practiced for some time. The process is variously described in U.S. Pat. Nos. 4,232,177; 4,307,254; 4,336,407; 4,504,687; 4,987,807; and 5,118,873. Likewise the production of alcohols such as tertiary butyl alcohol with concurrent reaction and distillation is known. See for example U.S. Pat. No. 4,982,022

The alcohol or water and isoolefin are fed to a distillation column reactor having a distillation reaction zone containing a suitable catalyst, such as an acid cation exchange resin, in the form of catalytic distillation structure, and also having a distillation zone containing inert distillation structure. As embodied in the etherification of $iC_4^=$'s and/or $iC_5^=$'s the olefin and an excess of methanol are first fed to a fixed bed reactor wherein most of the olefin is reacted to form the corresponding ether, methyl tertiary butyl ether (MTBE) or tertiary amyl methyl ether (TAME). The fixed bed reactor is operated at a given pressure such that the reaction mixture is at the boiling point, thereby removing the exothermic heat of reaction by vaporization of the mixture. The fixed bed reactor and process are described more completely in U.S. Pat. No. 4,950,803 which is hereby incorporated by reference.

The effluent from the fixed bed reactor is then fed to the distillation column reactor wherein the remainder of the $iC_4^=$'s or $iC_5^=$'s are usually converted to the ether or alcohol and the methanol or water is separated from the ether or alcohol which is withdrawn as bottoms. The $C_4$ or $C_5$ olefin stream generally contains only about 10 to 60 percent olefin, the remainder being inerts which are removed in the overheads from the distillation column reactor.

In some cases the distillation column reactor may be operated such that complete reaction of the isoolefin is not achieved for a particular reason and therefore there may be significant isoolefin in the overheads, that is, from 1 to 15 wt. %, along with unreacted methanol.

The HCN is fed to a hydrodesulfurization reactor where organic sulfur compounds are reacted with hydrogen to produce hydrogen sulfide which can be removed and converted to elemental sulfur by known means. In a preferred embodiment the reactor is a second distillation column reactor containing a hydrodesulfurization catalyst and the reaction is carried out simultaneously with distillation.

The conditions suitable for the hydrodesulfurization of naphtha in a distillation column reactor are very different from those in a standard trickle bed reactor, especially with regard to total pressure and hydrogen partial pressure. Typical conditions in a reaction distillation zone of a naphtha hydrodesulfurization distillation column reactor are:

| | |
|---|---|
| Temperature | 450-700° F. |
| Total Pressure | 75-300 psig |
| $H_2$ partial pressure | 15-75 psi |
| LHSV of naphtha | about 1-5 |
| $H_2$ rate | 10-1000 SCFB |

The operation of the distillation column reactor results in both a liquid and vapor phase within the distillation reaction zone. A portion of the vapor is hydrogen while a portion is vaporous hydrocarbon from the petroleum fraction. Actual separation may only be a secondary consideration.

Without limiting the scope of the invention it is proposed that the mechanism that produces the effectiveness of the process is the condensation of a portion of the vapors in the reaction system, which occludes sufficient hydrogen in the condensed liquid to obtain the requisite intimate contact between the hydrogen and the sulfur compounds in the presence of the catalyst to result in their hydrogenation.

The result of the operation of the process in the distillation column reactor is that lower hydrogen partial pressures (and thus lower total pressures) may be used. As in any distillation there is a temperature gradient within the distillation column reactor. The temperature at the lower end of the column contains higher boiling material and thus is at a higher temperature than the upper end of the column. The lower boiling fraction, which contains more easily removable sulfur compounds, is subjected to lower temperatures at the top of the column which provides for greater selectivity, that is, less hydrocracking or saturation of desirable olefinic compounds. The higher boiling portion is subjected to higher temperatures in the lower end of the distillation column reactor to crack open the sulfur containing ring compounds and hydrogenate the sulfur.

It is believed that the distillation column reaction is a benefit first, because the reaction is occurring concurrently with distillation, the initial reaction products and other stream components are removed from the reaction zone as quickly as possible reducing the likelihood of side reactions. Second, because all the components are boiling the temperature of reaction is controlled by the boiling point of the mixture at the system pressure. The heat of reaction simply creates more boil up, but no increase in temperature at a given pressure. As a result, a great deal of control over the rate of reaction and distribution of products can be achieved by regulating the system pressure. A further benefit that this reaction may gain from distillation column reactions is the washing effect that the internal reflux provides to the catalyst thereby reducing polymer build up and coking. Finally, the upward flowing hydrogen acts as a stripping agent to help remove the $H_2S$ which is produced in the distillation reaction zone.

The mercaptans may also be removed by reacting them with the diolefins to form higher boiling sulfides("thioetherification"). The higher boiling sulfides can be separated from lighter hydrocarbon components of the stream by fractionation. Diolefins not converted to sulfides can be selectively hydrogenated to mono-olefins. Certain $C_5$ olefins, for example pentene-1 and 3-methyl butene-1 are isomerized during the process to more beneficial isomers.

Catalysts which are useful in the mercaptan-diolefin reaction include the Group VIII metals. Generally the metals are deposited as the oxides on an alumina support. The supports are usually small diameter extrudates or spheres. The catalyst may then be prepared in the form of a catalytic distillation structure. The catalytic distillation structure must be able to function as catalyst and as mass transfer medium as described in U.S. Pat. No. 5,510,568. The catalyst must be suitably supported and spaced within the column to act as a catalytic distillation structure. Catalytic distillation structures useful for this purpose are disclosed in U.S. Pat. Nos. 4,731,229 and 5,073,236.

Suitable catalysts for the reaction include 0.34 wt % Pd on 7 to 14 mesh $Al_2O_3$ (alumina) spheres, designated as G-68C and 0.4 wt % Pd on 7 to 14 mesh alumina spheres designated as G-68C-1, supplied by Süd Chemie. Typical physical and chemical properties of the catalysts as provided by the manufacturer are as follows:

TABLE I

| Designation | G-68C | G-68C-1 |
|---|---|---|
| Form | Sphere | Sphere |
| Nominal size | 7 × 14 mesh | 7 × 14 mesh |
| Pd. wt % | 0.3 (0.27-0.33) | 0.4 (0.37-0.43) |
| Support | High purity alumina | High purity alumina |

The catalyst may also catalyzes the selective hydrogenation of the polyunsaturated compounds contained within the light cracked naphtha and to a lesser degree the isomerization of some of the mono-olefins. Generally the relative absorption preference is as follows:

(1) Sulfur compounds (2) diolefins (3) mono-olefins

The reaction of the mercaptans with diolefins is described by the equation:

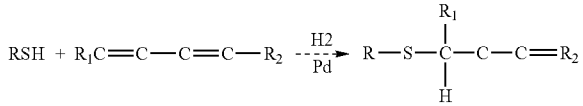

wherein R, $R_1$ and $R_2$ are independently selected from hydrogen and hydrocarbyl groups of 1 to 20 carbon atoms This may be compared to the HDS reaction which consumes hydrogen. The only hydrogen consumed in the removal of the mercaptans in the thioetherification is that necessary to keep the catalyst in the reduced state (which is the same for the isomerization). If there is concurrent hydrogenation of the dienes, then hydrogen will be consumed in that reaction.

A preferred use of the thioetherification reaction is in the primary splitter where the catalyst will concurrently selectively hydrogenate the remaining diolefins. Alternatively the thioetherification reaction may be used on a mid cut in lieu of the hydrodesulfurization.

In another alternative the sulfur may be removed by chemisorption on known sulfur adsorbents such as cobalt oxide on porous alumina as disclosed in U.S. Pat. No. 4,179,361, reduced nickel as disclosed in U.S. Pat. No. 4,634,515 or copper metal, copper oxide or copper chromite on an inorganic porous carrier as disclosed in U.S. Pat. No. 4,204,947. Also U.S. Pat. No. 4,188,285 discloses the use of a synthetic zeolite for the adsorption of thiophenes. In addition U.S. Pat. No. 5,807,475 teaches the use of nickel- or molybdenum-exchanged forms of zeolites X and Y for the removal of thiophenes and mercaptan from gasoline. Each of the patents discussed in this paragraph are incorporated by reference. The adsorbents are used in fixed beds generally in tandem so that one may be regenerated while the other is being used.

The term "full boiling range" naphtha as used herein may be defined as a $C_5$-475° F. boiling range fraction but may vary according to the operation of the particular fluid catalytic cracking unit to contain some $C_4$'s with end point as required. For example, in China the heavier ends may be included in the diesel cut and the end point of the naphtha is about 350° F.(180° C.).

The invention claimed is:

1. A process for the production of low sulfur, low olefin content gasoline from a cracked naphtha stream containing olefins and organic sulfur compounds, comprising the steps of:

(a) separating the cracked naphtha stream into at least three fractions by fractional distillation, said fractions comprising a light cracked naphtha fraction, a medium cracked naphtha fraction, and a heavy cracked naphtha fraction;

(b) treating the light cracked naphtha fraction to convert a portion of the olefins contained therein to oxygenated compounds;

(c) treating the heavy cracked naphtha fraction to remove a portion of the organic sulfur compounds contained therein; and (d) treating the medium cracked naphtha fraction to remove sulfur compounds.

2. The process according to claim 1 wherein said cracked naphtha stream contains polyunsaturated compounds and a portion of said polyunsaturated compounds is converted to monoolefins by hydrogenation concurrently with said separation by fractional distillation.

3. The process according to claim 1 wherein a portion of the olefins contained within said light cracked naphtha fraction is converted to ethers by reaction with alcohols.

4. The process according to claim 1 wherein a portion of the olefins contained within said light cracked naphtha fraction is converted to alcohols by reaction with water.

5. The process according to claim 1 wherein the organic sulfur compounds contained within said heavy cracked naphtha fraction are convened to hydrogen sulfide by reaction with hydrogen.

6. The process according to claim 1 wherein the organic sulfur compounds contained within said heavy cracked naphtha fraction are removed by chemisorption.

7. The process according to claim 1 wherein the treated light cracked naphtha fraction and the treated heavy cracked naphtha fraction are combined to form a low sulfur, low olefin gasoline.

8. The process according to claim 1 wherein said cracked naphtha stream contains mercaptans and a portion of said polyunsaturates comprise diolefins and a portion of said diolefins is reacted with a portion of said mercaptans to form sulfides.

9. The process according to claim 2 wherein said cracked naphtha stream contains mercaptans and a portion of said polyunsaturates comprise diolefins and a portion of said diolefins is reacted with a portion of said mercaptans to form sulfides.

10. The process according to claim 1 wherein said cracked naphtha stream is a full boiling range cracked naphtha.

11. A process for the production of low sulfur, low olefin content gasoline from a full boiling range cracked naphtha containing monoolefins, diolefins, polyunsaturated compounds and organic sulfur compounds, comprising the steps of:

(a) feeding hydrogen and said full boiling range cracked naphtha to a first distillation column reactor containing a bed of hydrogenation catalyst;

(b) concurrently in said first distillation column reactor (i) reacting hydrogen with a portion of said diolefins and polyunsaturated compounds in the presence of said hydrogenation catalyst to selectively hydrogenate said diolefins and polyunsaturated compounds to monooleflins, (ii) separating the full boiling range cracked naphtha into three fractions by fractional distillation, said fractions comprising a light cracked naphtha, a medium cracked naphtha fraction and a heavy cracked naphtha fraction, (iii) removing said light cracked naphtha fraction from said first distillation column reactor as a first overheads, (iv) removing said medium cracked naphtha from said first distillation column reactor as a first side draw, and (v) removing said heavy cracked naphtha fraction from said first distillation column reactor as a first bottoms;

(c) feeding said light cracked naphtha and water to a second distillation column reactor containing a bed of hydration catalyst;

(d) concurrently in said second distillation column reactor (i) reacting water with monoolefin in the presence of said hydration catalyst to form alcohols;

(ii) separating the unreacted water from the unreacted monoolefins and alcohols by fractional distillation;

(iii) removing the unreacted water from said second distillation column reactor as a second overheads, and (iv) removing the unreacted monoolefins and alcohols from said second distillation column reactor as a second bottoms;

(e) treating said medium cracked naphtha fraction to remove sulfur;

(f) feeding hydrogen and said heavy cracked naphtha fraction to a fixed bed single pass downflow reactor containing a bed of hydrodesulfuirization catalyst;

(g) reacting hydrogen and the organic sulfur compounds contained within said heavy cracked naphtha fraction to form hydrogen sulfide;

(h) removing the hydrogen sulfide and unreacted hydrogen from the effluent from said fixed bed single pass downflow reactor; and (i) combining the effluent from said fixed bed single pass downflow reactor with said second bottoms.

12. The process according to claim 11 wherein hydrogen and said medium cracked naphtha fraction are fed to a fixed bed single pass downflow reactor containing a bed of hydrodesulfurization catalyst wherein hydrogen and the organic sulfur compounds contained within said medium cracked naphtha fraction are reacted to form hydrogen sulfide.

13. The process according to claim 11 wherein said medium cracked naphtha fraction is fed to a thioetherification reactor where diolefins and mercaptans contained within said medium cracked naphtha fraction are reacted to form sulfides.

14. A process for the production of low sulfur, low olefin content gasoline from a full boiling range cracked naphtha containing monoolefins, diolefins, polyunsaturated compounds, mercaptans and organic sulfur compounds, comprising the steps of:

(a) feeding hydrogen and said full boiling range cracked naphtha to a first distillation column reactor containing a bed of hydrogenation catalyst;

(b) concurrently in said first distillation column reactor (i) reacting hydrogen with a portion of said diolefins and polyunsaturated compounds in the presence of said hydrogenation catalyst to selectively hydrogenate said diolefins and polyunsaturated compounds to monoolefins, (ii) separating the full boiling range cracked naphtha into three fractions by fractional distillation, said fractions comprising a light cracked naphtha fraction, and medium cracked naphtha fraction and a heavy cracked naphtha fraction, (iii) removing said light cracked naphtha fraction from said first distillation column reactor as a first overheads, (iv) removing said medium cracked naphtha fraction from said first distillation column reactor as a first side draw, and (v) removing said heavy cracked naphtha fraction from said first distillation column reactor as a first bottoms;

(c) feeding said light cracked naphtha fraction and a $C_1$ to $C_4$ alcohol to a second distillation column reactor containing a bed of etherification catalyst;

(d) concurrently in said second distillation column reactor (i) reacting alcohol with monoolefin in the presence of said etherification catalyst to produce ethers, (ii) separating the unreacted alcohol from the unreacted monoolefins and ethers by fractional distillation;

(iii) removing the unreacted alcohol from said second distillation column reactor as a second overheads, and (iv) removing the unreacted monoolefins and ethers from said second distillation column reactor as a second bottoms;

(e) treating said medium cracked naphtha fraction to remove sulfur compounds;

(f) feeding hydrogen and said heavy cracked naphtha fraction to a fixed bed single pass downflow reactor containing a bed of hvdrodesulfuirization catalyst;

(g) reacting hydrogen and the organic sulfur compounds contained within said heavy cracked naphtha fraction to form hydrogen sulfide;

(h) removing the hydrogen sulfide and unreacted hydrogen from the effluent from said fixed bed single pass downflow reactor; and (i) combining the effluent from said fixed bed single pass downflow reactor with said second bottoms.

15. The process according to claim 14 wherein the alcohol in said second overheads is recycled to said second distillation column reactor as reflux.

16. The process according to claim 14 wherein said medium cracked naphtha fraction is fed to a thioetherification reactor where diolefins and mercaptans contained within said medium cracked naphtha fraction are reacted to form sulfides.

17. The process according to claim 14, wherein hydrogen and said medium cracked naphtha fraction are fed to a fixed single pass downflow reactor containing a bed of hydrodesulfuirization catalyst wherein hydrogen and the organic sulfur compounds contained within said medium cracked naphtha fraction are reacted to form hydrogen sulfide.

* * * * *

UNITED STATES PATENT AND TRADEMARK OFFICE

CERTIFICATE OF CORRECTION

PATENT NO. : 7,431,827 B2
APPLICATION NO. : 10/974666
DATED : October 7, 2008
INVENTOR(S) : Kerry L. Rock et al.

It is certified that error appears in the above-identified patent and that said Letters Patent is hereby corrected as shown below:

In the Claims:

In Claim 5, column 7, line 27, the word "convened" should be --converted--.

In Claim 11, column 8, line 26, the word "hydrodesulfuirization" should be --hydrodesulfurization--.

In Claim 14, column 9, line 23, the word "hvdrodesulfuirization" should be --hydrodesulfurization--.

In Claim 17, column 10, line 18-19, the word "hydrodesulfuirization" should be --hydrodesulfurization--.

Signed and Sealed this

Thirtieth Day of December, 2008

JON W. DUDAS
*Director of the United States Patent and Trademark Office*